US005788537A

United States Patent [19]

Davis et al.

[11] Patent Number: 5,788,537

[45] Date of Patent: Aug. 4, 1998

[54] SHIELD ASSEMBLY FOR AN ELECTRICAL CONNECTOR

[75] Inventors: Wayne Samuel Davis, Harrisburg; Robert Neil Whiteman, Jr., Middletown, both of Pa.

[73] Assignee: The Whiteker Corporation, Wilmington, Del.

[21] Appl. No.: 547,087

[22] Filed: Oct. 23, 1995

Related U.S. Application Data

[63] Continuation-in-part of Ser. No. 411,027, Mar. 27, 1995, abandoned.

[51] Int. Cl.[6] ..... H01R 13/648

[52] U.S. Cl. ..... 439/607

[58] Field of Search ..... 439/607–610, 439/108, 101, 95

[56] References Cited

U.S. PATENT DOCUMENTS

| | | | |
|---|---|---|---|
| 4,457,576 | 7/1984 | Cosmos et al. | 439/607 |
| 4,582,384 | 4/1986 | Frantz et al. | 439/607 |
| 4,789,357 | 12/1988 | Yamaguchi et al. | 439/607 |
| 5,073,130 | 12/1991 | Nakamura | 439/607 |
| 5,158,481 | 10/1992 | Frantz | 439/607 |
| 5,273,459 | 12/1993 | Davis | 439/607 |
| 5,288,248 | 2/1994 | Chen | 439/607 |
| 5,397,246 | 3/1995 | Defibaugh et al. | 439/607 |
| 5,518,421 | 5/1996 | Davis | 439/607 |

FOREIGN PATENT DOCUMENTS

| | | |
|---|---|---|
| 0562311 A3 | 9/1992 | European Pat. Off. . |
| 0608813 A2 | 8/1994 | European Pat. Off. . |

*Primary Examiner*—Hien Vu

*Attorney, Agent, or Firm*—Anton P. Ness

[57] ABSTRACT

A shielding assembly for an electrical connector comprising: a connector receiving shell, a backshell assembled to the shell, tab receiving openings in the shell, tabs on the backshell projecting into the openings, the tabs engaging a housing of an electrical connector and biasing the housing forwardly relative to the shell.

4 Claims, 7 Drawing Sheets

SHIELD ASSEMBLY FOR AN ELECTRICAL CONNECTOR

CROSS REFERENCE TO RELATED APPLICATION

This application is a continuation-in-part of application Ser. No. 08/411,027 filed on Mar. 27, 1995, now abandoned.

FIELD OF THE INVENTION

The invention relates to a shield assembly for an electrical connector, the shield assembly comprising a backshell that interlocks with a front shell. The invention also relates to features on the shield assembly that interlock with an electrical connector.

BACKGROUND OF THE INVENTION

As described in U.S. Pat. No. 4,457,576, a shield assembly for an electrical connector comprise upper and lower backshells pivotally connected to a connector receiving shell by integrally connecting bights.

As described in U.S. Pat. No. 4,582,384, bent lugs on forward edges of two backshells engage in slots along rear edges of a connector receiving shell.

As described in U.S. Pat. No. 5,158,481, a shield assembly for an electrical connector comprises, a connector receiving shell provided with openings. A torsionable bearing member spans each opening. On each of two backshells, a hook and a pair of tabs project forwardly, the tabs register against the bearing member and the hook engages about the surface of the bearing member. As the corresponding backshell is pivoted about the bearing member, the tabs are rotated about the surface of the bearing member, so that the bearing member is captured between the hook and the tabs, and is slightly tensioned by torsional deflection. The tension provides excellent electrical contact and interlocking of the backshell with the connector receiving shell.

As described in U.S. Pat. No. 4,789,357, a shield assembly for an electrical connector is constructed of two parts that interlock. The two parts are constructed as partial enclosures to capture an electrical connector inside the two parts. Flaps on the two parts are bent over to overlap ends of the connector to retain the connector inside the two parts. Bends in the flaps creates internal stresses retained in the material of the flaps. Over time, these internal stresses will become relieved by allowing the material to relax and allow deformation of the bends. The flaps no longer will hold the connector tightly, which allows undesired shifting of the connector relative to the shield assembly. During repeated mating and unmating of the connector, forces are applied to the shield assembly, that will cause deformation of the flaps, and allow undesired shifting of the connector. During mating connection with another mating connector, the connector will shift backwards and away from the mating connector. This shift will cause incomplete wiping of the contacts during mating of the connector, to result in higher resistance and consequent voltage drops.

adverse shift of the connector relative to the shield assembly becomes more difficult to avoid when the connector is designed with a reduced size. The reduced size will require a shield assembly manufactured with thin metal. The thin metal is easier to deform, which will allow undesired shifting of the connector relative to the shield assembly.

SUMMARY OF THE INVENTION

The present invention provides a shield assembly for an electrical connector, which assembly envelops a connector, and resists shifting of the connector relative to the shield assembly.

An advantage of the invention resides in a shield assembly for an electrical connector, which assembly resists shifting of the connector relative to the shield assembly during mating connection of the connector with another mating electrical connector.

According to an embodiment, a shield assembly comprises, an interlocking mechanism for interlocking a conductive backshell and a conductive connector receiving shell, and the interlocking mechanism prevents shifting of a connector relative to the interlocked shells by interlocking with the connector.

According to an embodiment, a shield assembly provides an enclosure having a mating end to align a mating electrical connector for entry within the enclosure, and the shield assembly aligns electrical contacts on the electrical connector with mating electrical contacts on the mating electrical connector.

DESCRIPTION OF THE DRAWINGS

An embodiment will now be described with reference by way of example to the accompanying drawings, according to which.

DETAILED DESCRIPTION

Figure 1:
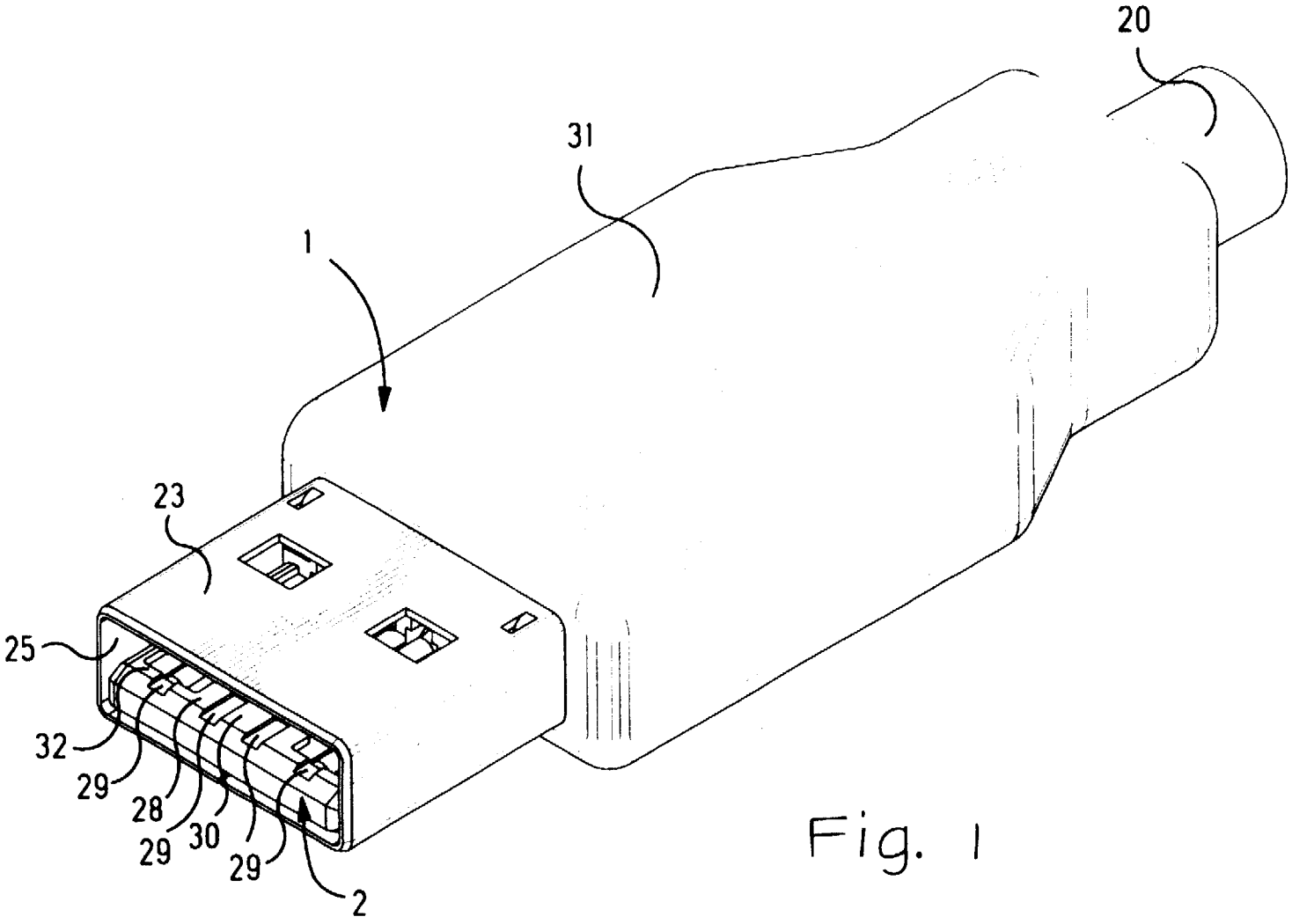
FIG. 1 is an isometric view of an electrical connector including a housing and a shield assembly connected on an electrical cable.
Figure 2:
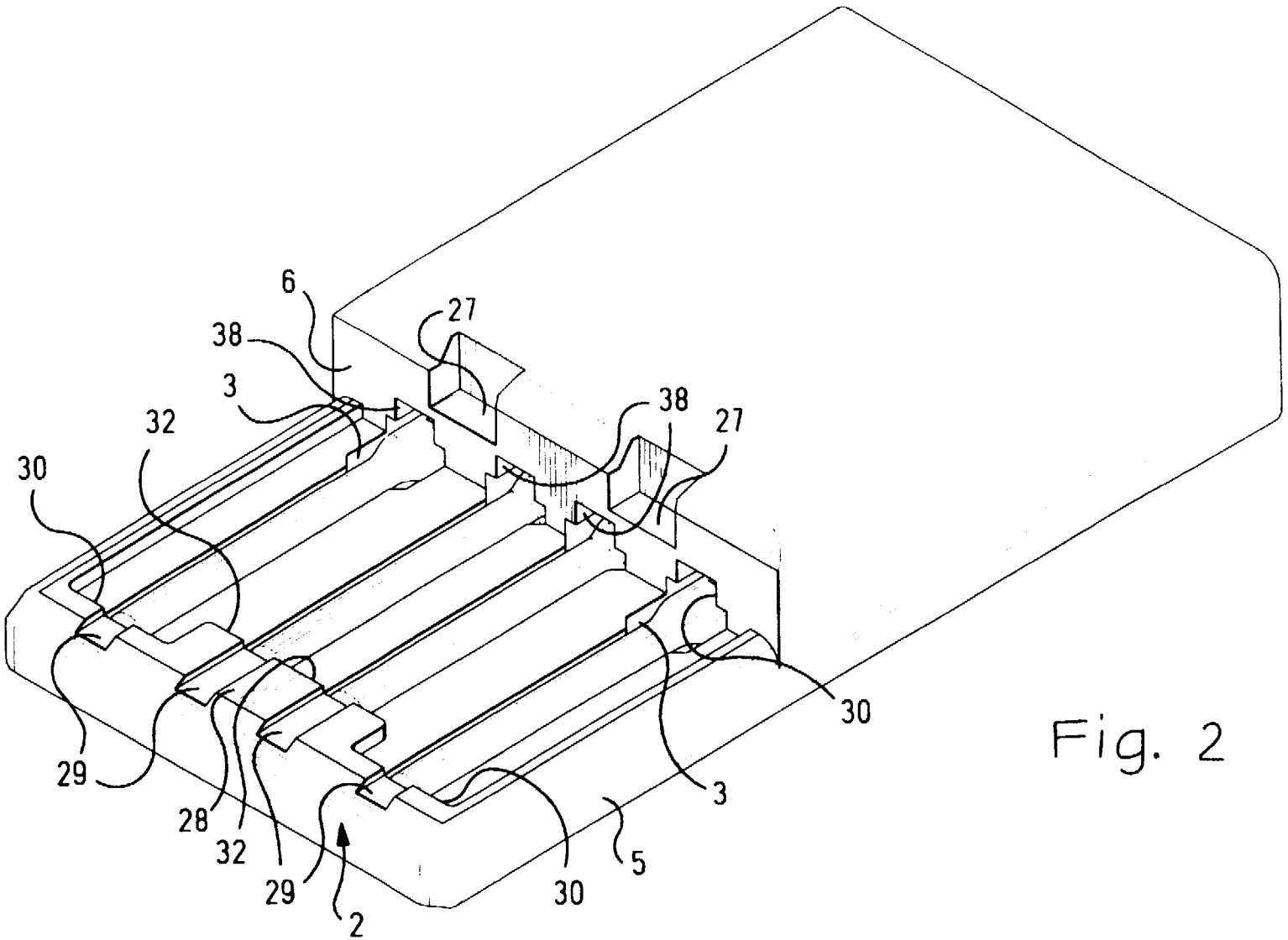
FIG. 2 is an isometric view of an insulating housing of the connector shown in FIG. 1.
Figure 3:
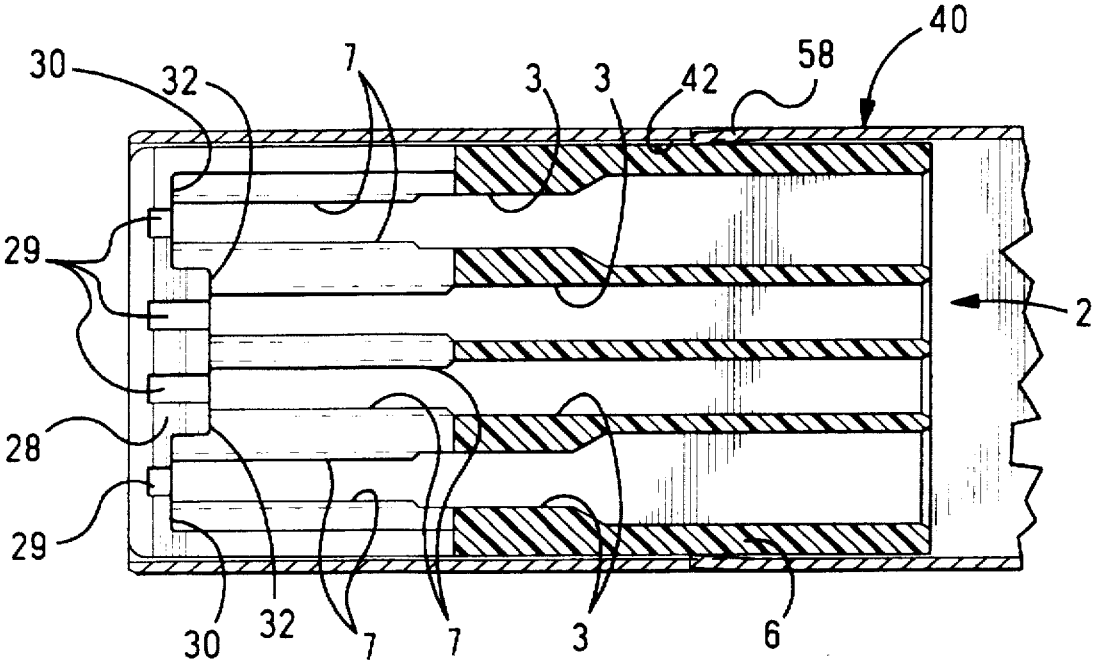
FIG. 3 is a section view of the housing shown in FIG. 3, together with a conductive shield of the connector shown in FIG. 1.
Figure 11:
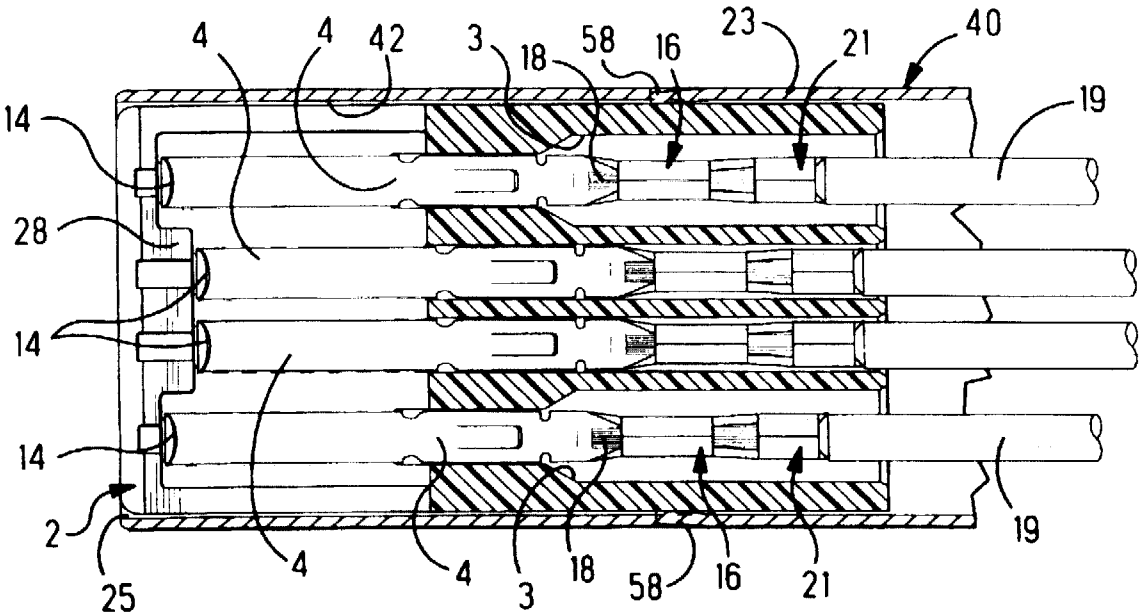
FIG. 11 and FIG. 12 are respective section views of the housing and the shield assembly of the connector as shown in FIG. 1.
Figure 12:
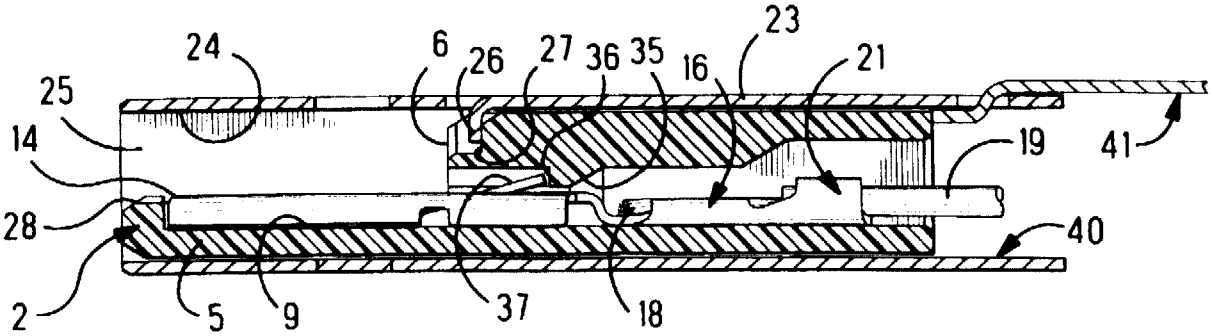

With more particular reference to FIGS. 1–3, an electrical connector 1 comprises, an insulating housing 2 , contact receiving cavities 3 in the housing 2 , and multiple electrical contacts 4, FIGS. 11 and 12, in corresponding cavities 3. Further details of construction are described in U.S. patent application entitled "ELECTRICAL CONNECTOR", Ser. No. 08/411,137 filed on even date, (now Ser. No. 08/841,024).

With reference to FIGS. 2–3, the housing 2 is, for example, of unitary molded plastic construction, and comprises a front section 5 and a rear section 6. overhangs 7 extend along lateral walls 8 of each corresponding cavity 3. Each corresponding cavity 3 is dovetail in cross section. The overhangs 7 on each corresponding cavity 3 comprise said lateral walls 8 beginning at a wider bottom 9 of the cavity 3 and inclining toward each other to a narrower elongated opening 10 between the overhangs 7.

Figure 6:
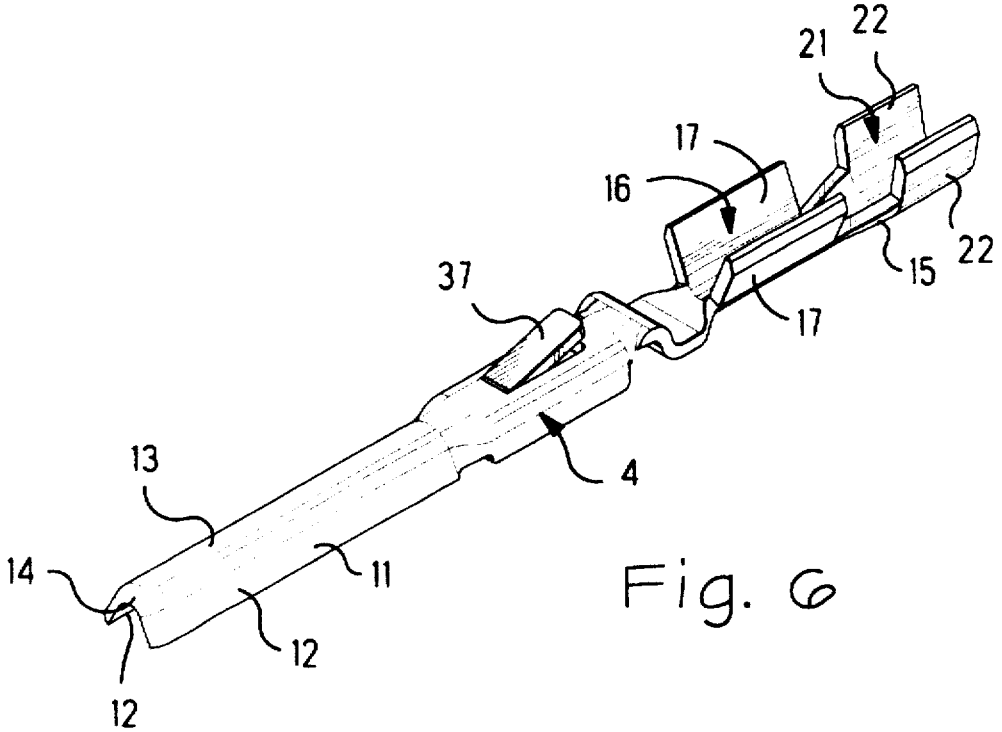
FIG. 6 is an isometric view of an electrical contact of the connector shown in FIG. 1.
Figure 5:
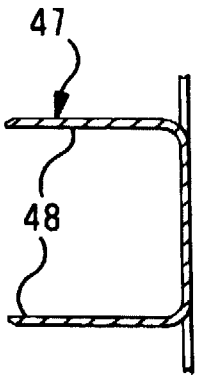
FIG. 5 is an end view with parts cut away of a strain relief portion of the shell shown in FIG. 5.

With reference to FIG. 6, each corresponding contact 4 is constructed, for example, of a stamped and formed unitary thin metal blank. A front section 11 of the contact 3 is of thin blade construction, and has elongated lateral sides 12 confined by the overhangs 7 in the corresponding cavities 3. Each contact 3 is constructed with an arch 13 extending from one lateral side 12 to the other lateral side 12. The arch 13 strengthens the otherwise weak and thin blade shape, and further provides the lateral sides 12 that can be confined under the corresponding overhangs 7. An elongated apex of each arch 13 projects in the opening 10 between the overhangs 7 on a corresponding cavity 3. Each apex projects outwardly above the overhangs 7, and provides a smooth, elongated, wiping contact surface.

Each apex provides a wiping contact surface for mating engagement with another mating electrical connector, not shown. A front edge 14, FIG. 6, on the apex of the arch 13 is beveled on to slope from rear to front where the apex projects outwardly of the corresponding contact receiving cavity 3. The beveled front edge 14 prevents stubbing of the contact 4 against another mating electrical connector during mating connection of the connector 1 with another mating electrical connector, not shown. Each corresponding rear section 15 of the corresponding contact 4 comprises, a first connection being a crimp barrel 16 formed by a first pair of wings 17 to form into an open barrel for crimp connection to a conductor portion 18, FIGS. 11 and 12, of an insulated wire 19 of an electrical cable 20, FIG. 1. A second connection is a second crimp barrel 21 formed by a second pair of wings 22 to form into an open barrel for crimp connection to insulation of the insulated wire 19.

With reference to FIGS. 11 and 12, an inclined front lip 28 on the housing 2 projects in front of each corresponding cavity 3 and in front of a contact 4 in each corresponding cavity 3. The inclined front lip 28 provides a funnel that biases mating electrical contacts, not shown, into the passage 24 for wiping engagement with each corresponding apex of the corresponding ones of the contacts 4. Each corresponding cavity 3 communicates with a corresponding groove 29 in the front lip 28. Each corresponding groove 29 is aligned with the apex of a corresponding contact 4 in the corresponding cavity 3.

First portions 30 of the lip 28 are longer in front of said selected ones of the corresponding contact receiving cavities 3 than second portions 32 of the lip 28 in front of the selected other ones of the corresponding contact receiving cavities 3. Selected ones of the corresponding contact receiving cavities 3 begin farther from the front end of the housing 2 than selected other ones of the corresponding contact receiving cavities 3. The contacts 4 in the cavities 3 advantageously mate in sequence with mating contacts of a mating electrical connector, not shown, depending upon their respective spacings in the cavities 3 from the front end of the housing 2. To complete the connector, FIG. 1, an overmold 31 of insulating plastic material is molded onto the shield 23 and the cable 20 that projects from the shield 23.

With reference to FIGS. 1, 11 and 12, a conductive shield 23 encircles the housing 2. A passage 24 has an opening 25 in a front end of the shield 23. The passage 24 extends along an interior of the shield 23 from the front of the housing 2 to the rear section 6 of the housing 2. The passage 24 spaces the interior of the shield 23 away from the apex of each corresponding contact 4. At least one forward stop tab 26, FIG. 12, projecting on the shield 23 is bent downward an extends transversely into a corresponding tab receiving recess 27 in a front end of the housing 2 to resist movement of the housing 2 forwardly with respect to the shield 23. The recess 27 extends from an outer periphery of the housing 2 that is against the shield 23.

With reference to FIG. 12, a corresponding projection 33 is on a corresponding interior wall 34 in each corresponding contact receiving cavity 3. A corresponding internal sloped wall 35 is on a rear of each corresponding projection 33 to bias a corresponding front edge 14 on a corresponding contact 4. A corresponding front facing shoulder 36 is on each corresponding projection 33. Each corresponding contact 4 has a rear projecting, resilient tine 37 facing a corresponding front facing shoulder 36. The tine 37 is resiliently deflectable to pass beyond the projection 33 as the contact 4 traverses the front section 11 of the corresponding cavity 3. The tine 37 springs outward and faces the shoulder 36 to resist movement of each corresponding contact 4 rearward relative to the housing 2. Aligned and in front of the projection, 33, a narrow channel 38 communicates with a front of the rear section 6. Walls on the channel 38 are spaced apart by the width of the channel 38. The spaced apart walls are as wide apart as to prove lateral support on opposite sides of the tine 38 to resist rotation of the contact 4 along its lengthwise axis.

With reference to FIGS. 4–8 and 10, the shield 23 comprises a shielding assembly 39, in turn, comprising, a connector receiving shell 40 and a backshell 41, each being of stamped and formed, unitary construction, fabricated from thin metal sheet having a plane of thickness. The shell 40 provides the passage 24 and the opening 25 at a mating front end of the shell 40. The shell 40 and backshell fit and slide one within the other. The shell 40 is formed with a tubular enclosure 42 with an open rear end receiving the housing 2 therein. The tab 26 is struck out of the thickness plane of the enclosure 42. A longitudinal seam 43 in the enclosure 42 intersects the front and rear end 43. Rearward of the enclosure 42, a channel 44 with three sides and an open side. The channel 44 provides an entrance to the rear end 43. Rearward of the channel 44, a flat tongue 46 of tapered shape separates the channel 44 and the enclosure 42 from a strain relief portion 47 that is connected to the tongue 46. The strain relief portion is a channel with clamping fingers 48. On the backshell 42, a strain relief portion 49 comprises a channel with clamping fingers 50 and an external indentation 51 in a base of the channel. The strain relief portions 47, 49 receive the cable 20, and enclose the cable 20. The clamping fingers 48 are deformed by bending, and are closed toward each other and encircle the clamping fingers 50. Further deformation of the clamping fingers 48 cause the clamping fingers to enter the indentation 51, in a manner described further in U.S. Pat. No. 5,518421.

The backshell 41 has a wide U-shaped defined by front channel 52. The channels 52 and 44 face each other, with the sides of the channel 52 fitting inside the channel 44, FIG. 10. Rearward of the channel 52, a flat tapered tongue 53 separates the channel 44 and the enclosure 42 from the strain relief portion 49 that is connected to the tongue 53. Flanges 54 project from the tapered edges 55 of the tongue 53.

Initially the flanges 54 are bent inward toward each other.

Figure 4:
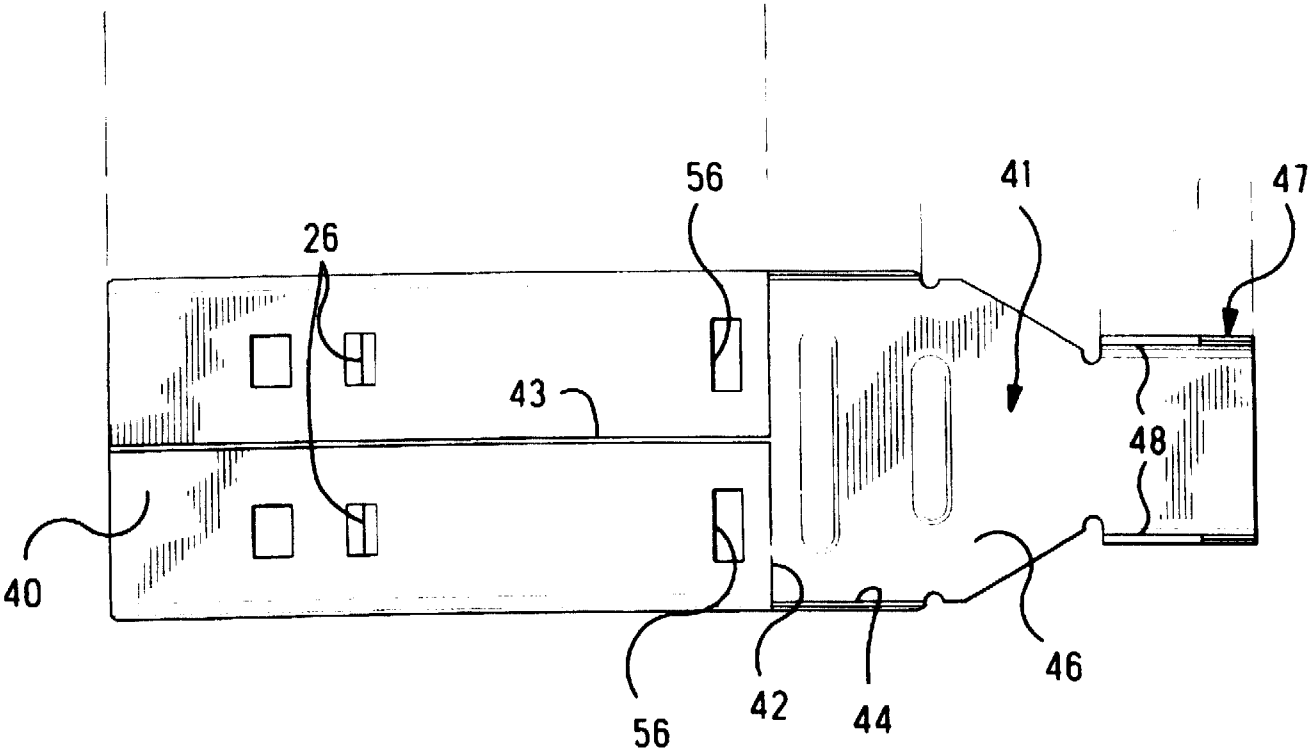
FIG. 4 is a top view of a connector receiving shell of the shield assembly as shown in FIG. 1.
Figure 8:
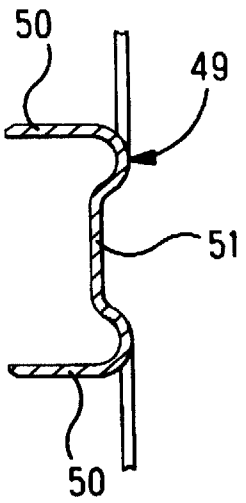
FIG. 8 is an end view with parts cut away of a strain relief portion of the backshell shown in FIG. 10.
Figure 7:
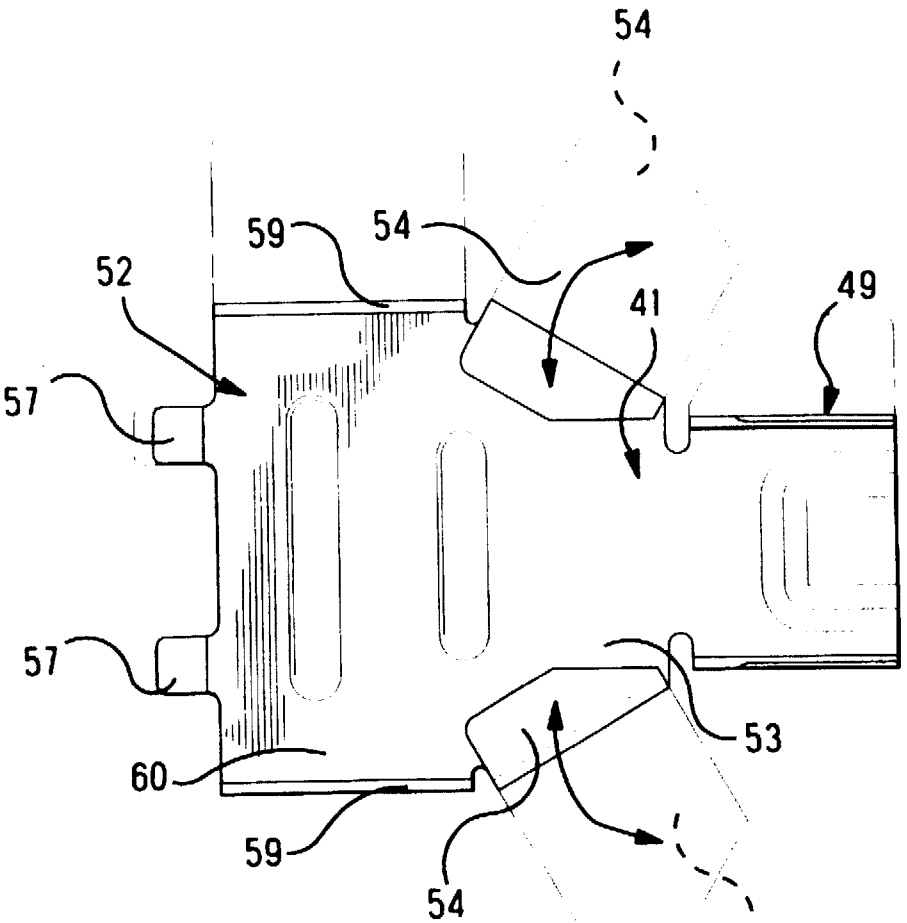
FIG. 7 is a bottom view of a backshell of the shield assembly as shown in FIG. 1.

As shown in FIGS. 4 and 7, openings 56 provide multiple locks on opposite sides of the seam 43.

Projecting tabs 57 in the form of projecting locks project from a front of the backshell 41 and are aligned with the openings 56. The backshell 41 is assembled to the front shell 40 by inserting the tabs 57 in respective openings 56, FIG.

Figure 9:
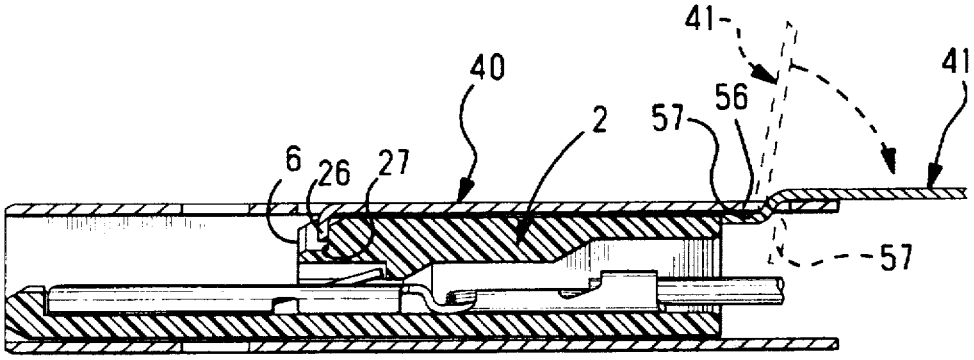
FIG. 9 is a view similar to FIG. 12, illustrating the backshell biasing the housing forwardly.
Figure 10:
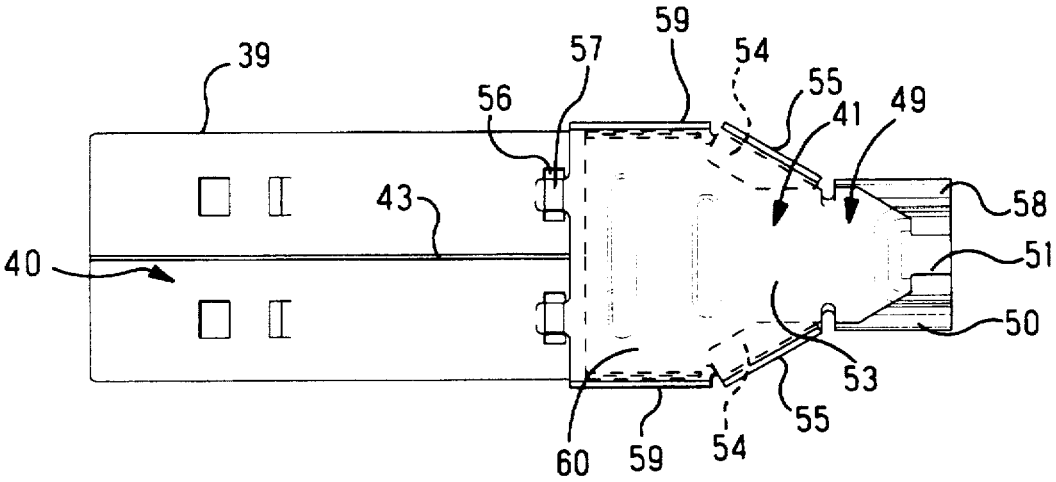
FIG. 10 is a view of a shielding assembly comprising the shell and the backshell.

9, with the backshell 41 being shown in phantom outline, and thereafter, by pivoting the backshell 41 toward the tongue 46 of the shell 40, FIG. 9. The flanges 54 are pivoted to engage and overlap against an interior of the tongue 46, resisting inward bending of the tongue 46 when the overmold 31 is applied over the shield 23. The tabs 57 enter the interior of the enclosure 42, and are pivoted to engage a rear end of the housing 2. Further pivoting of the tabs 57 will bias and urge the housing 2 forward against the tabs 26 on the enclosure 42. The tabs 57 resist movement of the housing 2 rearward relative to the shield assembly, while each tab 26 resist movement of the housing 2 forward. The tabs 57 and 26 are compressed against opposite ends of the housing 2, thereby interlocking with the housing 2 and preventing shifting of the housing 2. Each of the tabs 57 engages the housing 2 along its edge along the thickness plane. The tabs 57 are in compression along their thickness plane, and strongly resist deformation when mating forces are exerted on the shield assembly during mating connection of the connector 1 with another mating electrical connector. As shown in FIG. 11, inward projecting tines 58 are struck from the thickness plane of the enclosure 42 to engage opposite sides of the housing 2 to stabilize the housing 2 in the enclosure 42.

An advantage of the invention resides in a shield assembly for an electrical connector, which assembly resists shifting of the connector relative to the shield assembly during mating connection of the connector with another mating electrical connector.

Another advantage of the invention resides in an interlocking mechanism for interlocking a conductive backshell and a conductive connector receiving shell, and the interlocking mechanism prevents shifting of a connector relative to the interlocked shells by interlocking with the connector.

What is claimed is:

1. A shielding assembly for an electrical connector comprising:

a connector receiving shell having at least one forward stop tab extending into said shell, said shell further having tab receiving openings therein, a backshell assembled to said shell and having tabs projecting into the openings, leading edges of said tabs engaging a housing of the electrical connector and compressing against said housing, said tabs being in compression along respective thickness planes thereof, and said engagement and compression by said tab leading edges biasing said housing forwardly relative to said shell when urged forwardly by said backshell for said housing to abut said at least one forward stop tab to resist further forward movement.

2. A shielding assembly as recited in claim 1 wherein, a mating connector receiving passage is in a front end of the shell, the passage extending along an interior of the shell, and the passage spacing the interior of the shell away from an apex of each corresponding contact.

3. A shielding assembly as recited in claim 1 wherein, each said at least one forward stop tab on the shell extends into a corresponding recess in a front end of the housing.

4. A shielding assembly as recited in claim 1 wherein each said at least one forward stop tab extends transversely with respect to the direction of movement by the housing during assembly and is therefor deflectable incrementally forwardly upon abutment by the housing.

* * * * *